US011976398B2

(12) United States Patent
Matsubara

(10) Patent No.: US 11,976,398 B2
(45) Date of Patent: May 7, 2024

(54) THREAD STANDING DEVICE AND SEWING MACHINE

(71) Applicant: JANOME Corporation, Hachioji (JP)

(72) Inventor: Shotaro Matsubara, Hachioji (JP)

(73) Assignee: JANOME Corporation, Hachioji (JP)

( * ) Notice: Subject to any disclaimer, the term of this patent is extended or adjusted under 35 U.S.C. 154(b) by 144 days.

(21) Appl. No.: 17/849,704

(22) Filed: Jun. 27, 2022

(65) Prior Publication Data

US 2023/0043017 A1 Feb. 9, 2023

(30) Foreign Application Priority Data

Aug. 5, 2021 (JP) ..... 2021-128999

(51) Int. Cl.
*D05B 43/00* (2006.01)
*D05B 73/00* (2006.01)

(52) U.S. Cl.
CPC ..... *D05B 43/00* (2013.01)

(58) Field of Classification Search
CPC ..... D05B 43/00; D05B 73/02; D05B 73/005; B65H 49/28; B65H 54/54; B65H 54/543
See application file for complete search history.

(56) References Cited

U.S. PATENT DOCUMENTS

| | | | | |
|---|---|---|---|---|
| 2,036,035 | A * | 3/1936 | Giallanza | D05B 43/00 242/129.6 |
| 2,121,676 | A * | 6/1938 | Adamson | D05B 91/14 242/139 |
| 2,176,299 | A * | 10/1939 | Evans | D05B 91/14 294/100 |
| 2,610,599 | A | 9/1952 | Picciano et al. | |
| 5,285,740 | A * | 2/1994 | Yanagi | D05B 43/00 112/258 |
| 2006/0011119 | A1* | 1/2006 | Tseng | D05B 73/12 112/302 |
| 2018/0111732 | A1* | 4/2018 | Akerman | D05B 43/00 |
| 2019/0368093 | A1 | 12/2019 | Makiyama et al. | |

FOREIGN PATENT DOCUMENTS

| | | | |
|---|---|---|---|
| CN | 1523155 | A | 8/2004 |
| CN | 107460654 | A | 12/2017 |
| JP | 2019-208548 | A | 12/2019 |

* cited by examiner

*Primary Examiner* — Patrick J. Lynch
(74) *Attorney, Agent, or Firm* — Yokoi & Co., U.S.A.; Toshiyuki Yokoi

(57) ABSTRACT

In a thread standing device capable of switching a plurality of spool pins between a stored state and a deployed state and a sewing machine having the thread standing device, an operability is improved during the switching operation. In a thread standing device, a plurality of spool pins can be switched between a stored state and a deployed state, operation portions related to a switching operation of the plurality of spool pins is provided, and the plurality of spool pins are configured to be switched from the stored state to the deployed state when the operation portions are operated.

4 Claims, 5 Drawing Sheets

THREAD STANDING DEVICE AND SEWING MACHINE

CROSS-REFERENCES TO RELATED APPLICATIONS

This patent specification is based on Japanese patent application, No. 2021-128999 filed on Aug. 5, 2021 in the Japan Patent Office, the entire contents of which are incorporated by reference herein.

BACKGROUND OF THE INVENTION

1. Field of the Invention

The present invention relates to a thread standing device and a sewing machine having the thread standing device.

2. Description of the Related Art

In a lock stitch sewing machine, seams are formed by entangling an upper thread with a lower thread. The upper thread is wound around a thread reel and the thread reel is placed on a spool pin provided on a thread standing device of the sewing machine Conventionally, a thread standing device having a plurality of spool pins is known. In such a thread standing device, the sewing can be performed using a plurality of upper threads and an upper thread for replacement can be preliminarily placed. In addition, a thread standing device capable of storing the spool pins is proposed to downsize the sewing machine during storage. For example, Patent Document 1 shows a thread standing device having a plurality of spool pins attachable to an upper lid of the sewing machine. In the above described thread standing device, the spool pins can be stored so that the upper lid can be closed during the storage of the sewing machine.

[Patent Document 1] Japanese Unexamined Patent Application Publication No. 2019-208548

BRIEF SUMMARY OF THE INVENTION

In the thread standing device of Patent Document 1, in order to switch the spool pins from a stored state to a usage state (deployed state) where the thread reels can be placed on the spool pins, an operator should pull up each of a plurality of spool pins. Thus, there is a room for improvement in operability.

The present invention provides a thread standing device capable of switching a plurality of spool pins between a stored state and a deployed state and a sewing machine having the thread standing device to improve the operability of the switching operation.

In the present invention, a thread standing device of a sewing machine capable of switching a plurality of spool pins between a stored state and a deployed state, the thread standing device including: an operation portion related to a switching operation of the plurality of spool pins, wherein the plurality of spool pins are switched from the stored state to the deployed state when the operation portion is operated.

In the above described thread standing device, it is preferred that the thread standing device further includes a base which swingably supports the spool pins; a slider which is slidably supported by the base; and an elastic body which energizes the spool pins in a direction of switching from the stored state to the deployed state, wherein the slider includes a stopper and an actuating portion which makes the slider slide when the operation portion is operated, the spool pins include a stored locking portion configured to be engaged with the stopper in the stored state and a deployed locking portion configured to be engaged with the stopper in the deployed state, and the slider is configured to slide for releasing an engagement between the stored locking portion and the stopper and swinging the spool pins kept in the stored state by the elastic body and the deployed locking portion is configured to be engaged with the stopper to keep the spool pins in the deployed state when the operation portion is operated.

In the above described thread standing device, it is preferred that the plurality of spool pins are configured to be simultaneously switched from the stored state to the deployed state when the operation portion is operated.

In the above described thread standing device, it is preferred that the plurality of spool pins are configured to be sequentially switched from the stored state to the deployed state when the operation portion is operated.

In addition, the present invention also relates to the sewing machine including any one of the above described thread standing devices.

By using the thread standing device and the sewing machine having the thread standing device of the present invention, a plurality of spool pins is switched from the stored state and the deployed state when the operation portion is operated. Thus, the operability is improved.

DETAILED DESCRIPTION OF THE INVENTION

Figure 1:
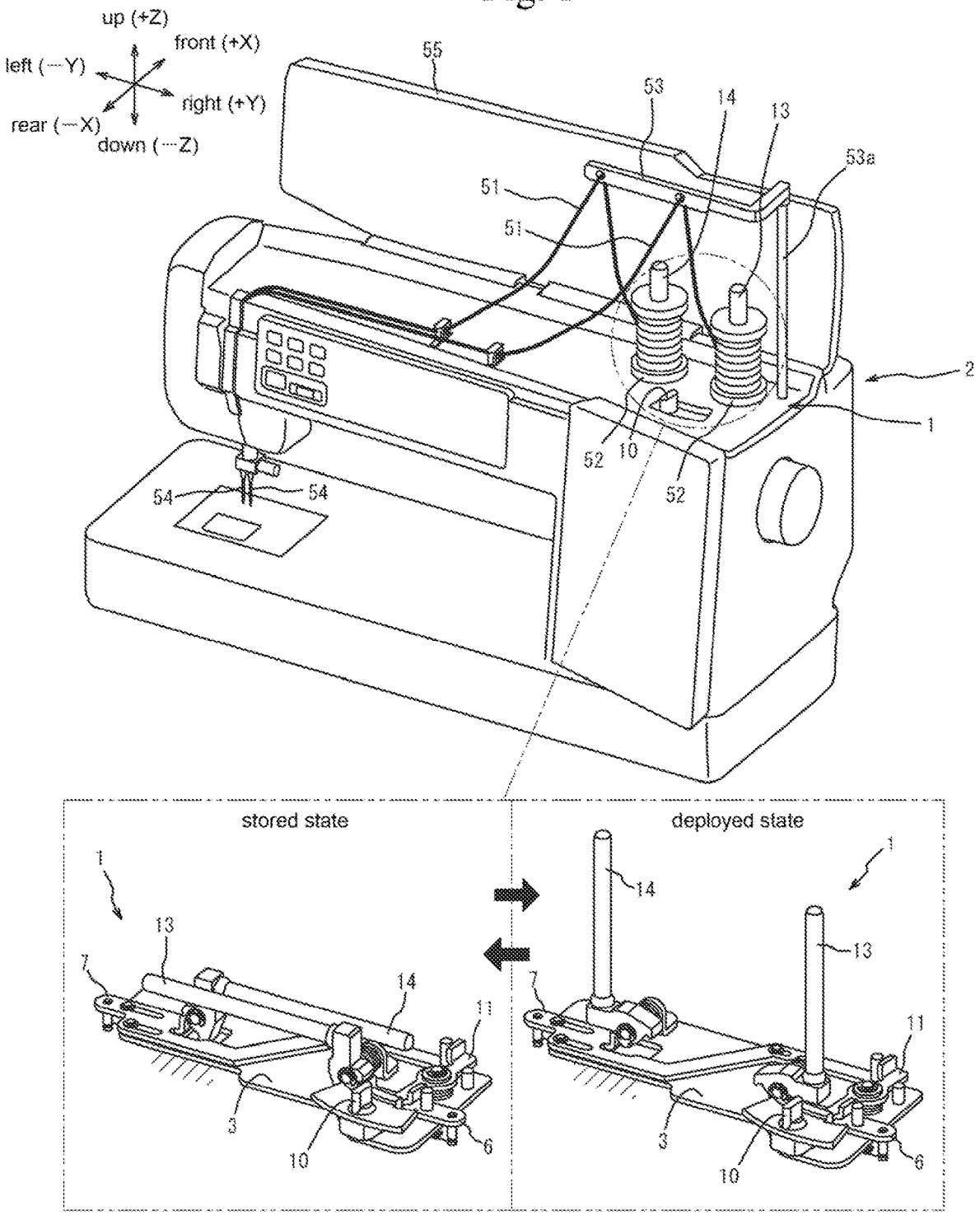
FIG. 1 is a perspective view of a sewing machine having the thread standing device in the first embodiment of the present invention and a perspective view showing a stored state and a deployed state of the spool pins in the thread standing device.

Hereafter, an embodiment of the thread standing device and an embodiment of the sewing machine having the thread standing device of the present invention will be explained with reference to the drawings. In the following explanation, the explanation will be made using the directions of right, left, front, rear, up, down, X, Y and Z shown in the drawings for convenience.

FIG. 1 is a drawing schematically showing the first embodiment of the thread standing device of the present invention and an embodiment of the sewing machine on which the thread standing device is mounted. Note that a partially enlarged view of FIG. 1 is related to a thread standing device 1 of the present embodiment showing the stored state where the later described two spool pins (right spool pin 13, left spool pin 14) are pressed down and the deployed state where the right spool pin 13 and the left spool pin 14 are raised up by moving the later described operation lever 10. In addition, a sewing machine 2 of the present embodiment shown in FIG. 1 is switched to a usage state (the deployed state of the right spool pin 13 and the left spool pin 14) where the sewing can be performed. In the sewing machine 2 of the present embodiment, thread reels 52 around which upper thread 51 is wound are placed on the right spool pin 13 and the left spool pin 14. In addition, the sewing machine 2 includes a threading antenna 53 where a support shaft 53*a* can be stored in the sewing machine 2 and the upper thread 51 is inserted into needle holes of needles 54 via the threading antenna 53 and other components. In the sewing machine 2 of the present embodiment, the right spool pin 13 and the left spool pin 14 can be switched to the stored state, the support shaft 53*a* can be stored in the sewing machine 2 and an upper lid 55 can be closed by the later described procedures. Namely, the sewing machine 2 can be downsized and dust and the like can be prevented from entering during the storage.

Figure 2:
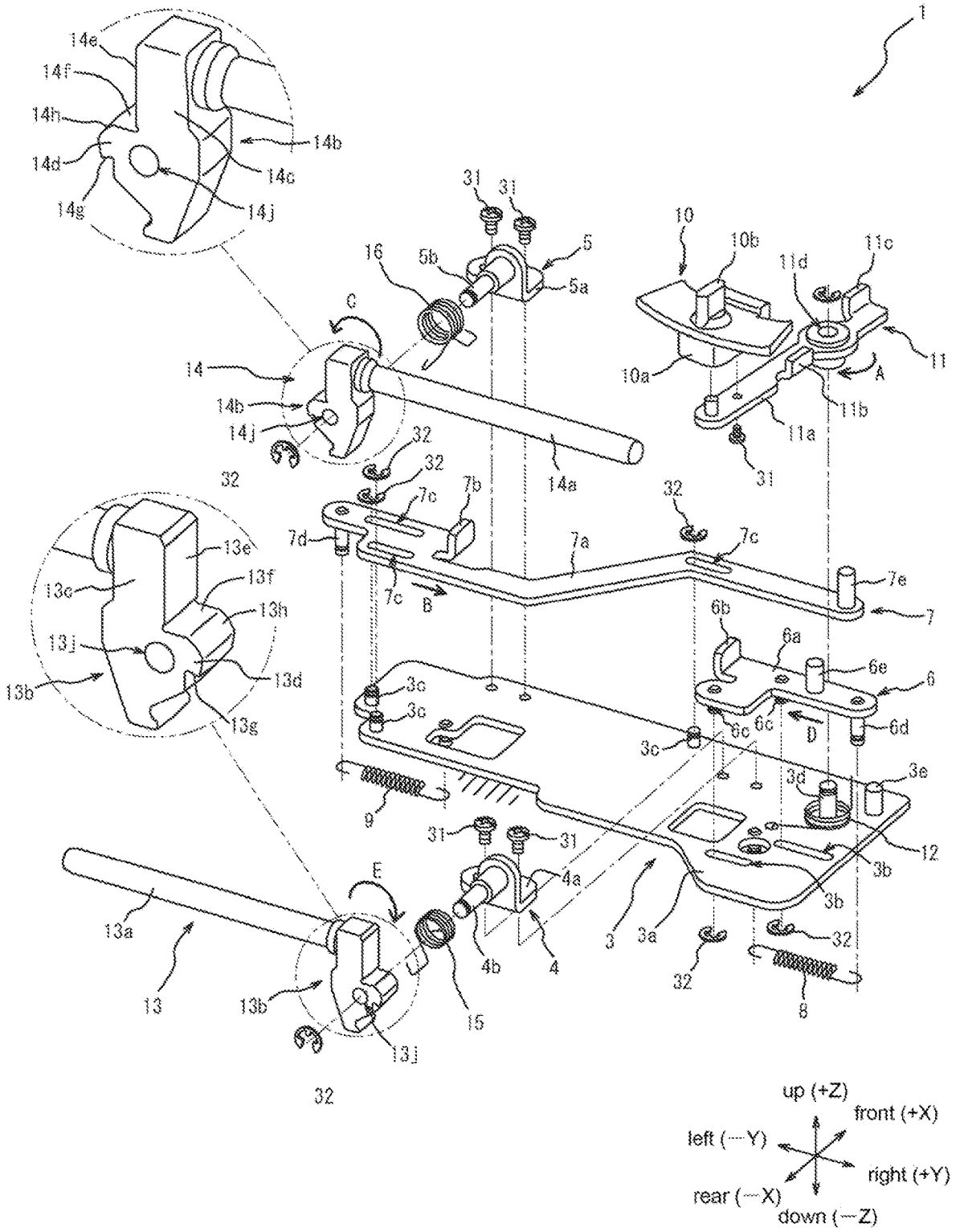
FIG. 2 is an exploded view of the thread standing device shown in FIG. 1.

FIG. 2 is an exploded view of the thread standing device 1. The thread standing device 1 of the present embodiment includes a base plate 3, a right shaft plate 4, a left shaft plate 5, a right slider 6, a left slider 7, a right tension spring 8, a left tension spring 9, an operation lever 10, an operation rod 11, an operation rod coil spring 12, a right spool pin 13, a left spool pin 14, a right-winding coil spring 15 and a left-winding coil spring 16. In addition, these members are mounted by the illustrated screws 31 and E-rings 32. Note that the base plate 3, the right shaft plate 4 and the left shaft plate 5 of the present embodiment correspond to "base" of the present specification. In addition, the right slider 6 and the left slider 7 of the present embodiment correspond to "slider" of the present specification, the operation lever 10 and the operation rod 11 of the present embodiment correspond to "operation portion" of the present specification, the right spool pin 13 and the left spool pin 14 of the present embodiment correspond to "spool pin" of the present specification and the right-winding coil spring 15 and the left-winding coil spring 16 of the present embodiment correspond to "elastic body" of the present specification.

The base plate 3 includes a base plate body 3*a*, two long holes 3*b* penetrating through the base plate body 3*a* and extending in the left-right direction and three slider pins 3*c* protruded upward from the base plate body 3*a*. In addition, the base plate 3 includes an operation rod rotating shaft 3*d* located on the right part of the base plate body 3*a* so as to be protruded upward and an operation rod stopper 3*e* located near the operation rod rotating shaft 3*d* so as to be protruded upward. Although the reference numeral is omitted in FIG. 2, the base plate 3 includes two spring pins protruded downward from the base plate body 3*a* so that one end portion of the right tension spring 8 and one end portion of the left tension spring 9 are hooked on the spring pins. The base plate 3 of the present embodiment is mounted on the frame of the sewing machine 2 by not illustrated screws.

As illustrated, the right shaft plate 4 and the left shaft plate 5 have the same shape. The right shaft plate 4 and the left shaft plate 5 include shaft plate bodies 4*a*, 5*a* having an L-shape and spool pin rotating shafts 4*b*, 5*b* protruded rearward from the shaft plate bodies 4*a*, 5*a* respectively. As illustrated, the right shaft plate 4 and the left shaft plate 5 are mounted on the base plate 3 by the screws 31.

The right slider 6 includes a right slider body 6*a* having a plate shape. The right slider body 6*a* is provided with a right stopper 6*b* formed by folding the right slider body 6*a* upward. In addition, the right slider 6 includes two slider pins 6*c* protruded downward from the right slider body 6*a* so that the slider pins 6*c* are inserted into the long holes 3*b*. After the slider pins 6*c* are inserted into the long holes 3*b*, the E-rings 32 are fitted around the slider pins 6*c*. Thus, the right slider 6 can be slidably mounted on the base plate 3. In addition, the right slider 6 includes a spring pin 6*d* protruded downward from the right slider body 6*a* and a right actuating pin 6*e* protruded upward from the right slider body 6*a*.

The left slider 7 includes a left slider body 7*a* having a plate shape. The length of the left slider body 7*a* is longer than that of the right slider 6. The left slider body 7*a* is provided with a left stopper 7*b* formed by folding the left slider body 7*a* upward and three long holes 7*c* extended in the left-right direction so that the slider pins 3*c* are inserted into the long holes 7*c*. After the long holes 7*c* are inserted around the slider pins 3*c*, the E-rings 32 are fitted around the slider pins 3*c*. Thus, the left slider 7 can be slidably mounted on the base plate 3. In addition, the left slider 7 includes a spring pin 7*d* protruded downward from the left slider body 7*a* and a left actuating pin 7*e* protruded upward from the left slider body 7*a*.

Note that the above described right stopper 6*b* and left stopper 7*b* correspond to "stopper" of the present specification and the right actuating pin 6*e* and the left actuating pin 7*e* correspond to "actuating portion" of the present specification.

One end portion of the right tension spring 8 is hooked on the above described not illustrated spring pin provided on the base plate 3 and the other end portion is hooked on the spring pin 6*d* of the right slider 6. Consequently, an energizing force is applied to the right slider 6 in the direction directed from right to left (the direction of arrow mark D shown in FIG. 2).

One end portion of the left tension spring 9 is hooked on the above described spring pin provided on the base plate 3 and the other end portion is hooked on the spring pin 7*d* of the left slider 7. Consequently, an energizing force is applied to the left slider 7 in the direction directed from left to right (the direction of arrow mark B shown in FIG. 2).

The operation lever 10 includes an operation lever body 10*a* located below and held by the operation rod 11 and a knob portion 10*b* protruded upward from the operation lever body 10*a*.

The operation rod 11 includes an operation rod body 11*a* having a plate shape. The operation rod body 11*a* is provided with a right pressing portion 11*b* and a left pressing portion 11*c* formed by folding the operation rod body 11*a* upward and a shaft hole 11*d* so that the operation rod rotating shaft 3*d* is inserted into the shaft hole 11*d*.

As illustrated, the above described operation lever 10 is mounted on the operation rod 11 by the screw 31. As illustrated, the operation rod 11 is rotatably mounted on the base plate 3 by inserting the shaft hole 11*d* around the operation rod rotating shaft 3*d* while interposing the operation rod coil spring 12 and fitting the E-rings 32 around the operation rod rotating shaft 3*d*. After the operation rod 11 is mounted, an energizing force is applied to the operation rod 11 by the operation rod coil spring 12 in a clockwise direction in a plan view (the direction of arrow mark A shown in FIG. 2).

The right spool pin 13 includes a right rod-shaped portion 13*a* having a circular shape in a cross-section of an XZ plane and a right fixing portion 13*b* provided on one end portion of the right rod-shaped portion 13*a*. As shown in a partially enlarged view of FIG. 2, the right fixing portion 13*b* includes a base portion 13*c* extended in the up-down direction and a protruded portion 13*d* extended rightward from the base portion 13*c* (extended in the opposite direction of the right rod-shaped portion 13*a*) when the right rod-shaped portion 13*a* is directed in the left-right direction. In the base portion 13*c*, a right side surface located at an upper portion of the protruded portion 13*d* is referred to as a deployed locking portion 13*e*, an upper surface of the protruded portion 13*d* is referred to as a deployed stopper portion 13*f* and a lower surface of the protruded portion 13*d* is referred to as a stored locking portion 13*g*. Note that the protruded portion 13*d* includes a curved surface having an arc shape at a connection portion between the upper surface and the right side surface of the protruded portion 13*d*. In the following explanation, the above described curved surface is referred to as a pushing-out cam 13*h*. In addition, the right fixing portion 13*b* is provided with a shaft hole 13*j* so as to be inserted around the spool pin rotating shaft 4*b* of the right shaft plate 4.

The left spool pin 14 includes a left rod-shaped portion 14*a*, a left fixing portion 14*b*, a base portion 14*c*, a protruded portion 14*d*, a deployed locking portion 14*e*, a deployed stopper portion 14*f*, a stored locking portion 14*g*, a pushing-out cam 14*h* and a shaft hole 14*j* which have the same configurations as those of the above described right spool pin 13. Note that the left spool pin 14 has the same shape as the right spool pin 13 and the left spool pin 14 is rotated by 180 degrees around the vertical axis when compared to the right spool pin 13. Namely, although the shapes of the positons of the components forming the left spool pin 14 are same as those of the right spool pin 13, the explanation will be made by using different reference numerals for convenience.

The right spool pin 13 is rotatably mounted on the right shaft plate 4 by inserting the shaft hole 13*j* around the spool pin rotating shaft 4*b* while interposing the right-winding coil spring 15 and fitting the E-rings 32 around the spool pin rotating shaft 4*b*. After the right spool pin 13 is mounted, an energizing force is applied to the right spool pin 13 by the right-winding coil spring 15 in a clockwise direction in a viewpoint viewed from rear to front (the direction of arrow mark A shown in FIG. 2).

The left spool pin 14 is rotatably mounted on the left shaft plate 5 by inserting the shaft hole 14*j* around the spool pin rotating shaft 5*b* while interposing the left-winding coil spring 16 and fitting the E-rings 32 around the spool pin rotating shaft 5*b*. After the left spool pin 14 is mounted, an energizing force is applied to the left spool pin 14 by the left-winding coil spring 16 in a counter-clockwise direction in a viewpoint viewed from rear to front (the direction of arrow mark C shown in FIG. 2).

The thread standing device 1 composed of the above described components is operated as shown in FIGS. 3A, 3B and FIGS. 4A, 4B. The operation lever 10 is omitted in FIGS. 3A, 3B and FIGS. 4A, 4B for the convenience of explanation.

Figure 3A:
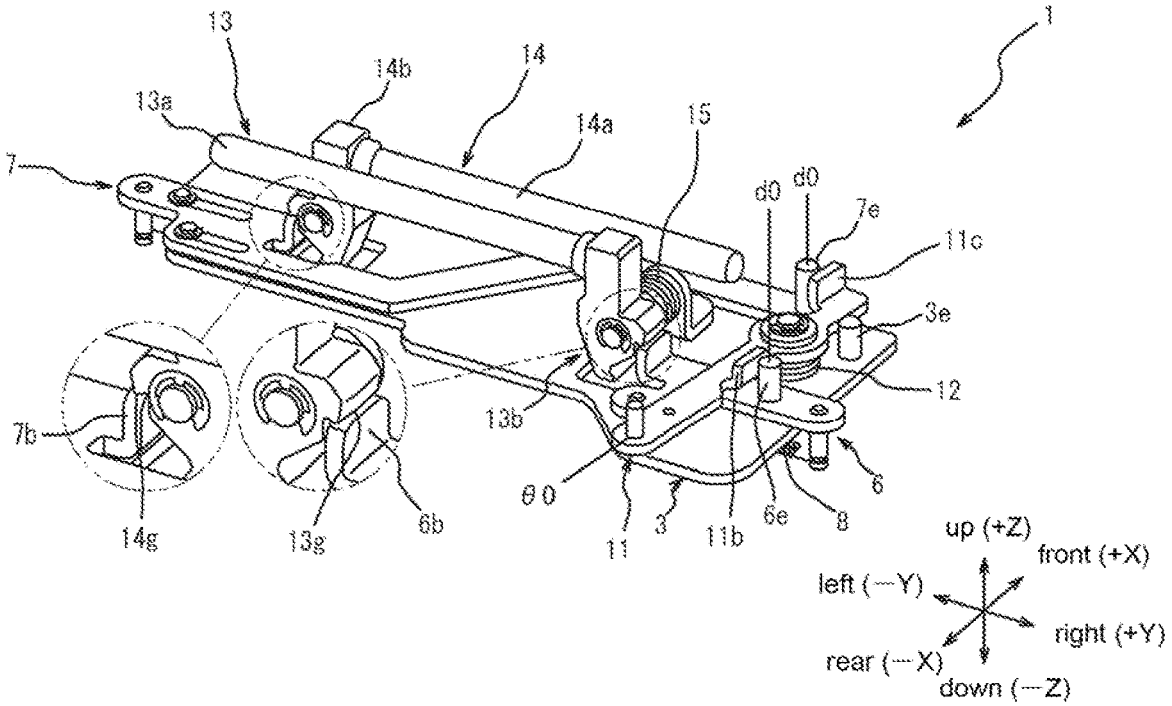
FIGS. 3A and 3B are explanation drawings related to operations of the thread standing device shown in FIG. 1.

First, in the state shown in FIG. 3A (stored state), the operation rod 11 is stopped in a state of being pressed against the operation rod stopper 3*e* by an energizing force energized by the operation rod coil spring 12 (energizing force of clockwise direction in a plan view).

In the above described state, the right slider 6 is moved leftward by an energizing force of the right tension spring 8 and the right actuating pin 6*e* is in contact with the right pressing portion 11*b*. In addition, the left slider 7 is moved rightward by an energizing force of the left tension spring 9 (shown in FIG. 2) and the left actuating pin 7*e* is in contact with the left pressing portion 11*c*.

In the above described state, the stored locking portion 13*g* of the right spool pin 13 is pressed against the right stopper 6*b* of the right slider 6 and the stored locking portion 14*g* of the left spool pin 14 is pressed against the left stopper 7*b* of the left slider 7. Thus, the right spool pin 13 and the left spool pin 14 are stopped in a horizontally inclined posture (posture where the right rod-shaped portion 13*a* and the left rod-shaped portion 14*a* are directed in the left-right direction.

Note that the rotation angle of the operation rod 11 in the stored state shown in FIG. 3A is referred to as θ0 and the position of the right actuating pin 6*e* and the left actuating pin 7*e* in the left-right direction is referred to as d0.

Figure 3B:
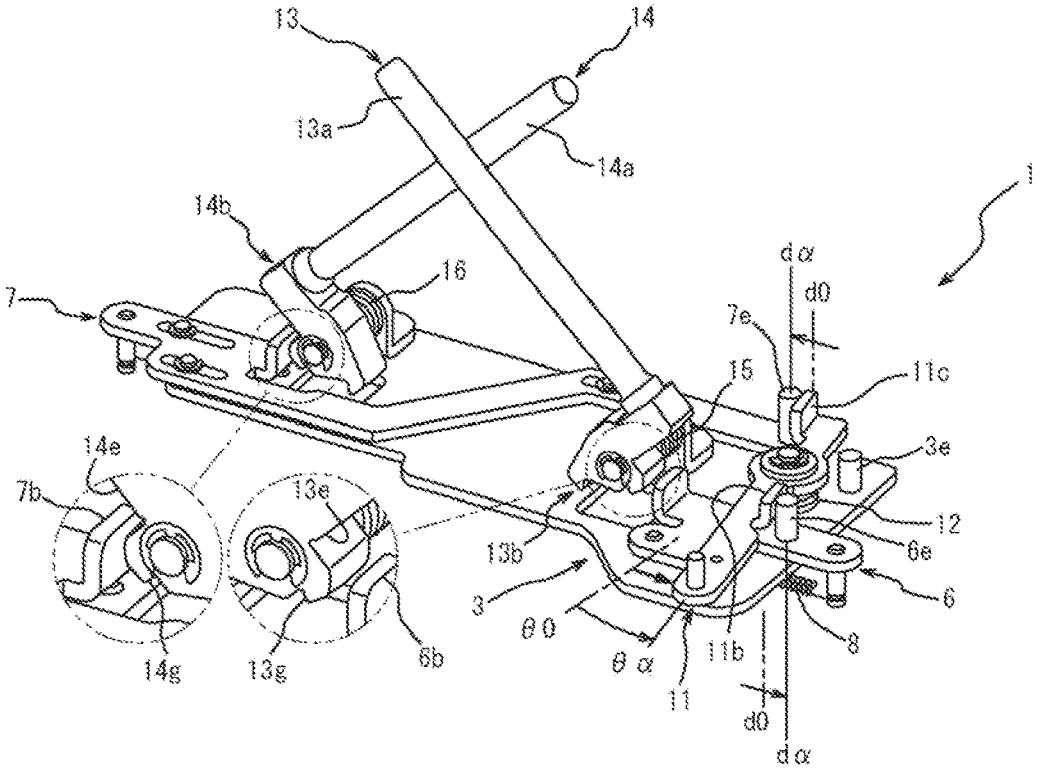

FIG. 3B shows the state that an operator operates the operation lever 10 (shown in FIG. 2) to rotate the operation rod 11 in a clockwise direction in a plan view. In FIG. 3B, the operation rod 11 is rotated from the rotation angle θ0 shown in FIG. 3A to a rotation angle θα. When the operation rod 11 is rotated, the right pressing portion 11*b* presses the right actuating pin 6*e* rightward and the left pressing portion 11*c* presses the left actuating pin 7*e* leftward. Thus, the right slider 6 is slid rightward and the left slider 7 is slid leftward. Note that FIG. 3B shows the state that the right slider 6 and the left slider 7 stopped at the position d0 in FIG. 3A are slid to a position dα.

As described above, when the right slider 6 and the left slider 7 are slid, the right stopper 6*b* is separated from the stored locking portion 13*g* and the left stopper 7*b* is separated from the stored locking portion 14*g*. Therefore, the right spool pin 13 is rotated in a clockwise direction in a viewpoint viewed from rear to front by an energizing force of the right-winding coil spring 15 and the left spool pin 14 is rotated in a counter-clockwise direction in a viewpoint viewed from rear to front by an energizing force of the left-winding coil spring 16.

Figure 4A:
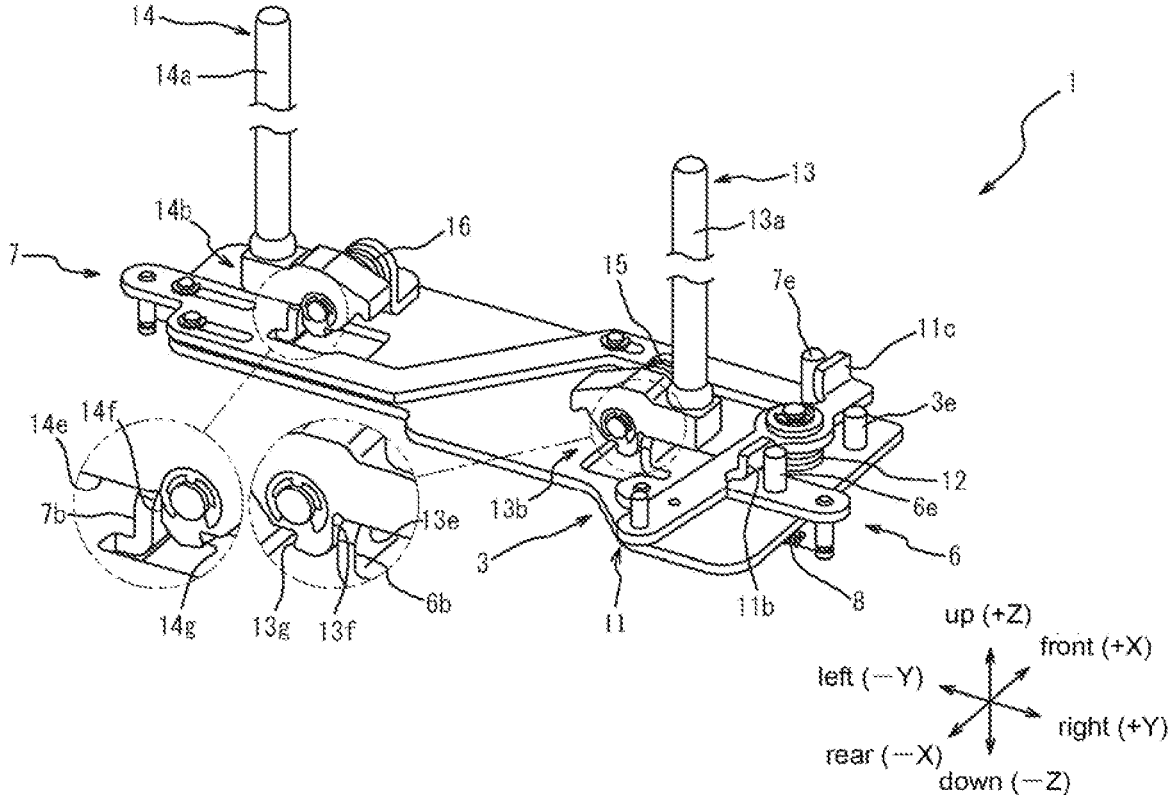
FIGS. 4A and 4B are explanation drawings related operations after FIGS. 3A and 3B.

When the right spool pin 13 is rotated in a clockwise direction, the deployed locking portion 13*e* is in contact with the right stopper 6*b* as shown in FIG. 4A. Therefore, the right spool pin 13 is stopped in a posture raised upward. In addition, when the left spool pin 14 is rotated in a counter-clockwise direction, the deployed locking portion 14*e* is in contact with the left stopper 7*b*. Thus, the left spool pin 14 is stopped in a posture raised upward. As described above, in the thread standing device 1 of the present embodiment, the right spool pin 13 and the left spool pin 14 in the stored state shown in FIG. 3A can be switched to the deployed state shown in FIG. 4A by operating the operation lever 10.

When the operator releases a hand from the operation lever 10, the operation rod 11 is rotated in a clockwise direction in a plan view as shown in FIG. 4A until the operation rod 11 is pressed against the operation rod stopper 3*e* or until the right stopper 6*b* is in contact with the deployed stopper portion 13*f* or until the left stopper 7*b* is in contact with the deployed stopper portion 14*f* by the operation rod coil spring 12. Even when the operation rod 11 is rotated, the deployed locking portion 13*e* is still in contact with the right stopper 6*b* and the deployed locking portion 14*e* is still in contact with the left stopper 7*b*. Thus, the right spool pin 13 and the left spool pin 14 are kept in the deployed state.

Figure 4B:
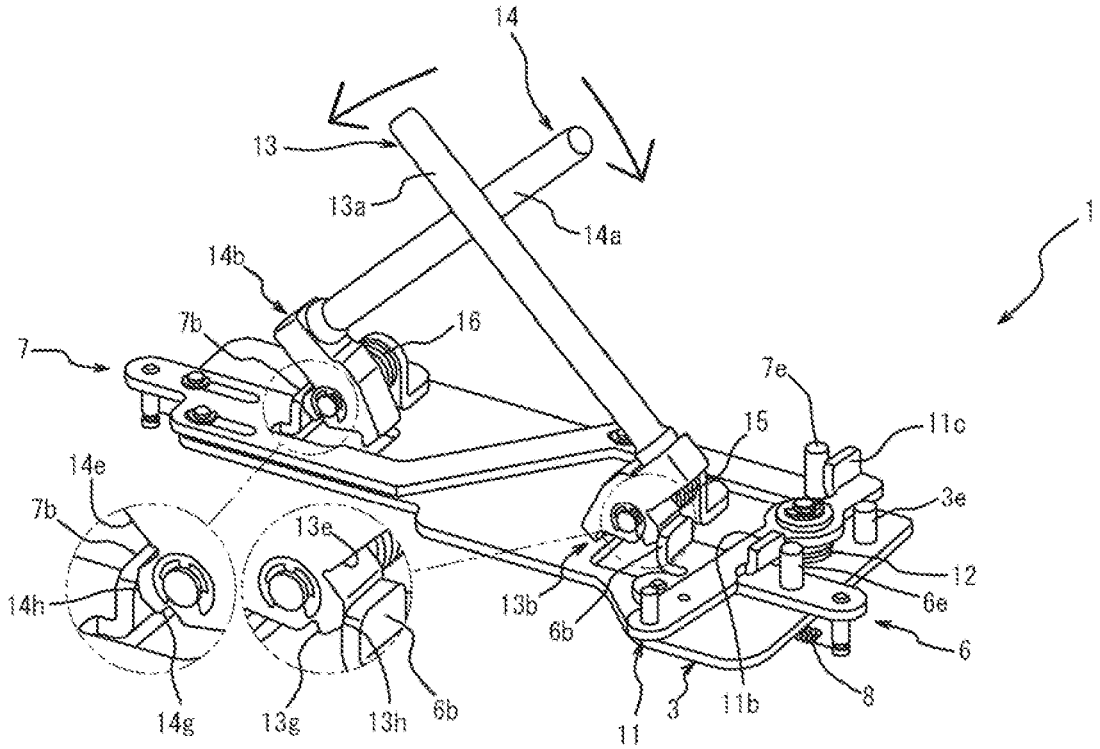

FIG. 4B shows the middle state of switching the right spool pin 13 and the left spool pin 14 from the deployed state to the stored state. When the operator presses down the right spool pin 13 in the direction of the illustrated arrow marks (counter-clockwise direction in a viewpoint viewed from rear to front), the right fixing portion 13*b* presses the right stopper 6*b* to slide the right slider 6 rightward. When the right spool pin 13 is further rotated to the horizontally inclined posture shown in FIG. 3A, the state of pressing the right stopper 6*b* by the right fixing portion 13*b* is released and the right slider 6 is moved leftward by an energizing force of the right tension spring 8. Thus, the right stopper 6*b* and the stored locking portion 13*g* are engaged with each other and the right spool pin 13 is kept in the stored state. In the present embodiment, since the pushing-out cam 13*h* having a curved surface is provided on a corner portion of the stored locking portion 13*g*, a sliding amount of the right slider 6 when the stored locking portion 13*g* is rotated to press the right stopper 6*b* is smaller compared to the case where the pushing-out cam 13*h* is not provided. Namely, since an amount of deflection of extending the right tension spring 8 is smaller when the right slider 6 is slid rightward, a force required for pressing down the right spool pin 13 is smaller.

The left spool pin 14 in the deployed state can be also switched to the stored state same as the right spool pin 13. Note that the right slider 6 and the left slider 7 of the present embodiment are independently operated when switched from the deployed state to the stored state. Accordingly, when switching the right spool pin 13 and the left spool pin 14 from the deployed state to the stored state, it is possible to press down the right spool pin 13 and the left spool pin 14 simultaneously or press down one of them to switch it to the stored state and then press down the other.

Next, the second embodiment of the thread standing device of the present invention will be explained with reference to FIGS. 5A to 5C. In the following explanation, the difference from the above described thread standing device 1 will be explained and the explanation of the common configurations will be omitted by adding the same reference numerals in FIGS. 5A to 5C. In addition, since the operation of switching from the deployed state to the stored state of the above thread standing device 1 shown in FIG. 4B is same as that of a thread standing device 1B of the present embodiment, the operation from the stored state to the deployed state will be explained below.

The thread standing device 1B includes a right slider 6B instead of the above described right slider 6 provided on the thread standing device 1. The right slider 6B is different from the right slider 6 in the position of the right actuating pin 6*e* with respect to the right slider body 6*a*.

Figure 5A:
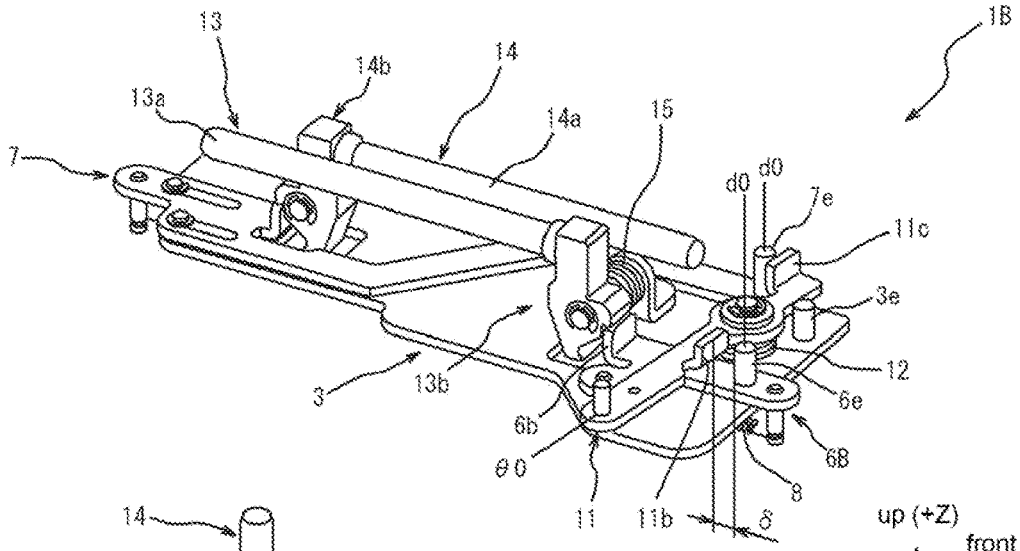
FIGS. 5A to 5C are explanation drawings related operations of the thread standing device in the second embodiment.

The right spool pin 13 and the left spool pin 14 provided on the thread standing device 1B is stopped in a horizontally inclined posture in the stored state shown in FIG. 5A. In the stored state, the operation rod 11 and the left slider 7 of the thread standing device 1B of the present embodiment are located at the same positon as the operation rod 11 and the left slider 7 of the above described thread standing device 1. Namely, the rotation angle θ0 of the operation rod 11 of the thread standing device 1B in the stored state and the position d0 of the left actuating pin 7*e* provided on the left slider 7 in the left-right direction are same as the rotation angle of the operation rod 11 and the position of the left actuating pin 7*e* in the left-right direction shown in FIG. 3A respectively. On the other hand, the right actuating pin 6*e* of the right slider 6B of the present embodiment is provided at the position separated rightward from the right pressing portion 11*b* by a distance 6 in the stored state shown in FIG. 5A. Note that the distance 6 is approximately same as the distance from the position d0 to the positon da shown in FIG. 3B.

Figure 5B:
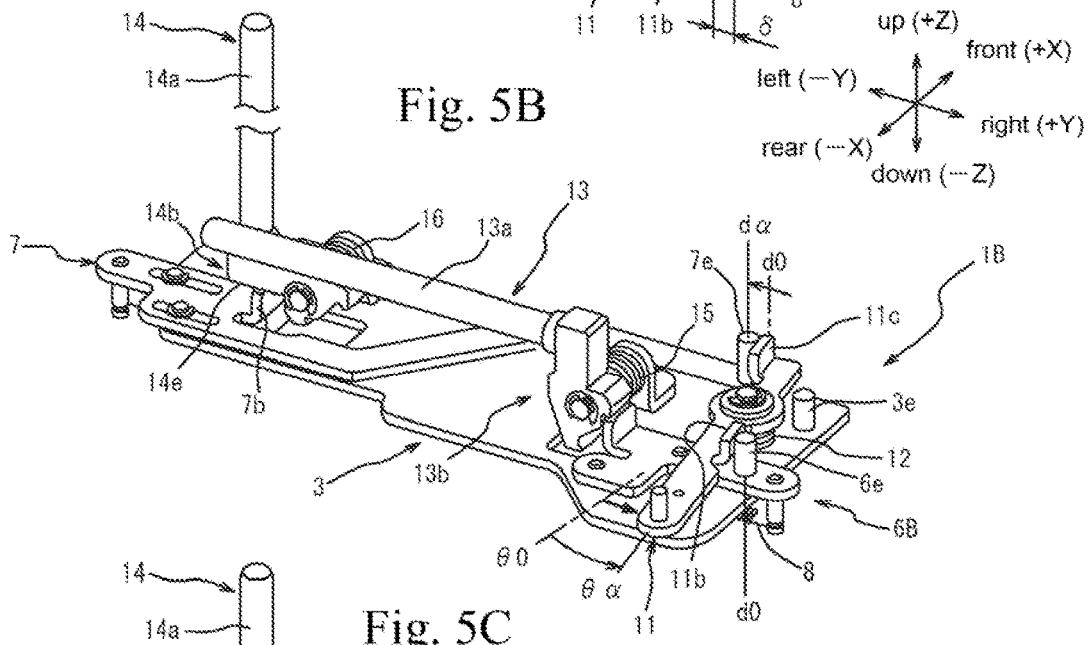

Also in the thread standing device 1B of the present embodiment, when switching from the stored state to the deployed state, the operator operates the operation lever 10 (shown in FIG. 2) to rotate the operation rod 11 in a counter-clockwise direction in a plan view shown in FIG. 5B. When the operation rod 11 is rotated from the rotation angle θ0 shown in FIG. 5A to the rotation angle θα shown in FIG. 5B, the left pressing portion 11*c* is moved leftward to press the left actuating pin 7*e* from the positon d0 to the position dα. Thus, the left slider 7 is slid leftward. Accordingly, after the left spool pin 14 is rotated by an energizing force of the left-winding coil spring 16, the left spool pin 14 is kept in the deployed state shown in FIG. 5B.

In a state that the operation rod 11 is rotated to the rotation angle θα, the right pressing portion 11*b* is moved rightward. Here, since the right pressing portion 11*b* and the right actuating pin 6*e* are originally separated from each other by the distance 6 which is approximately same distance between the position d0 to the position dα, the right pressing portion 11*b* is moved so as to be approximately in contact with the right actuating pin 6*e* as shown in FIG. 5B. Thus, the right spool pin 13 is stopped still in the stored state.

When the operator releases a hand from the operation lever 10 in this state, the operation rod 11 and the right slider 6 operated as shown in FIG. 5B are moved to the position of FIG. 5A while the left spool pin 14 is still the deployed state. Namely, when the operation lever 10 is rotated to the rotation angle θα, only the left spool pin 14 can be switched from the stored state to the deployed state while the right spool pin 13 is still the stored state.

Figure 5C:
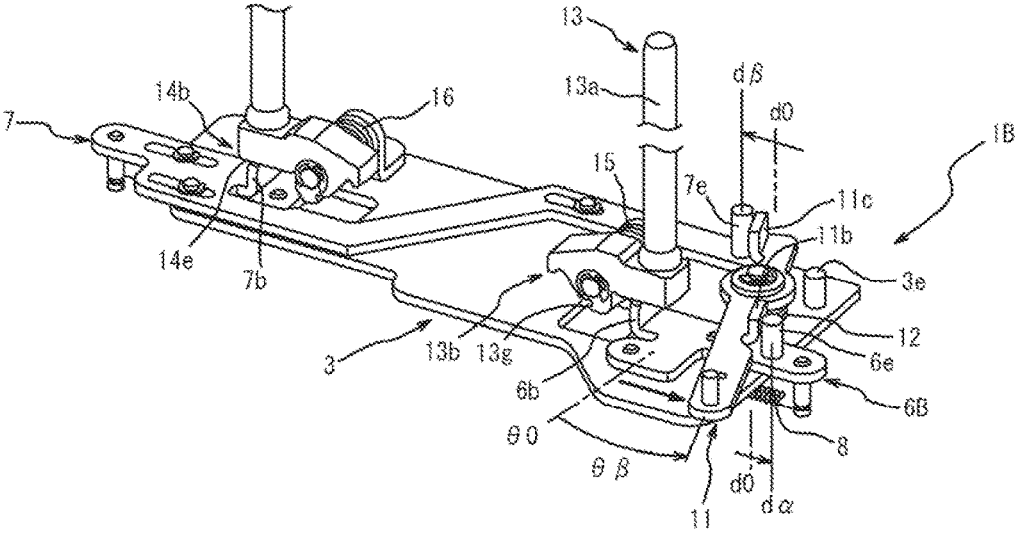

On the other hand, in order to switch both the right spool pin 13 and the left spool pin 14 to the deployed state, the operation rod 11 is rotated to a rotation angle θβ as shown in FIG. 5C. Note that the rotation angle θβ is larger than the rotation angle θα. Although the right pressing portion 11*b* is moved so as to be approximately in contact with the right actuating pin 6*e* in a state that the operation rod 11 is rotated to the rotation angle θα, the right actuating pin 6*e* which is located at the position d0 in the left-right direction in the stored state as shown in FIG. 5A can be moved to the position dα by rotating the operation rod 11 to the rotation angle θβ in the present embodiment. Namely, since the right slider 6 is slid rightward and the right stopper 6*b* is separated from the stored locking portion 13*g*, the right spool pin 13 is rotated by an energizing force of the right-winding coil spring 15 and switched to the deployed state shown in FIG. 5C. When the operation rod 11 is rotated to the rotation angle θα, the left actuating pin 7*e* pressed by the left pressing portion 11*c* is moved to the position dβ which is more separated from the positon d0 than the position dα. Namely, as shown in FIG. 5C, the left stopper 7*b* in this state is further moved leftward compared to the positon shown in FIG. 5B. However, since the length of the deployed locking portion 14*e* is sufficiently ensured in the present embodiment, the left stopper 7*b* is in contact with the deployed locking portion 14*e* and the deployed state is kept even in the state shown in FIG. 5C.

As described above, in the thread standing device 1B, the right spool pin 13 and the left spool pin 14 can be sequentially switched from the stored state to the deployed state in accordance with an operation amount of the operation lever 10. Namely, the operator can select the number of the spool pins of the deployed state in accordance with the sewing operation of the sewing machine. Thus, the operability can be improved and the usability can be improved.

Although the embodiments realizing the present invention are exemplified above, the present invention is not limited to a specific embodiment. Unless particularly limited in the above described explanation, various modification and change are possible in the range of the scope of the present invention described in the claims. In addition, the above described effects of the embodiments merely exemplify the effects arisen from the present invention. The effects of the present invention are not limited to the above described effects.

For example, the thread standing device 1B shown in FIGS. 5A to 5C is configured so that the left spool pin 14 is switched to the deployed state and then the right spool pin 13 is switched to the deployed state in accordance with the operation amount of the operation lever 10. However, the order of switching to the deployed state can be reversed.

In addition, the number of the spool pins to be switched from the stored state to the deployed state is two in the above described embodiment. However, it is also possible to switch three or more spool pins from the stored state to the deployed state by adding a new slider in addition to the right slider 6 and the left slider 7 and a new pressing portion in addition to the right pressing portion 11*b* and the left pressing portion 11*c* provided on the operation rod 11, for example.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A thread standing device of a sewing machine capable of switching a plurality of spool pins between a stored state and a deployed state, the thread standing device comprising:

an operation portion configured to be moved for switching the plurality of spool pins;

a base which swingably supports the plurality of spool pins;

a plurality of sliders which is slidably supported by the base; and an elastic body which energizes the plurality of spool pins in a direction of switching from the stored state to the deployed state, wherein each of the plurality of sliders includes a stopper configured to keep each of the spool pins in the stored state, each of the plurality of spool pins includes a stored locking portion configured to be engaged with the stopper in the stored state, when the operation portion is moved, the stopper is slid from a state of being engaged with the stored locking portion to a state being separated from the stored locking portion for switching all of the plurality of spool pins from the stored state to the deployed state by an energizing force of the elastic body.

2. The thread standing device according to claim 1, wherein when the operation portion is moved, the plurality of spool pins are configured to be simultaneously switched from the stored state to the deployed state.

3. The thread standing device according to claim 1, wherein when the operation portion is moved, the plurality of spool pins are configured to be sequentially switched from the stored state to the deployed state.

4. A sewing machine including the thread standing device of claim 1.

* * * * *